US006332342B2

(12) United States Patent
McClain et al.

(10) Patent No.: US 6,332,342 B2
(45) Date of Patent: Dec. 25, 2001

(54) METHODS FOR CARBON DIOXIDE DRY CLEANING WITH INTEGRATED DISTRIBUTION

(76) Inventors: James B. McClain, 8008 Chadbourne Ct., Raleigh, NC (US) 27613; Timothy J. Romack, 5810 Forest Ridge Dr., Durham, NC (US) 27713; James P. DeYoung, 110 Ashworth Dr., Durham, NC (US) 27707; R. Bradley Lienhart, 206 Old Pro's Way, Cary, NC (US) 27513; Joseph M. DeSimone, 7315 Crescent Ridge Dr., Chapel Hill, NC (US) 27516; Kenneth L. Huggins, 614 Capital Blvd., Raleigh, NC (US) 27603

( * ) Notice: Subject to any disclaimer, the term of this patent is extended or adjusted under 35 U.S.C. 154(b) by 0 days.

(21) Appl. No.: 09/842,603

(22) Filed: Apr. 26, 2001

Related U.S. Application Data

(62) Division of application No. 09/497,823, filed on Feb. 3, 2000, now Pat. No. 6,248,136.

(51) Int. Cl.[7] ..... D06B 9/06; D06F 43/08
(52) U.S. Cl. ..... 68/18 R; 8/142
(58) Field of Search ..... 8/142; 68/18 R

(56) References Cited

U.S. PATENT DOCUMENTS

| | | | |
|---|---|---|---|
| 1,358,168 | 11/1920 | McCutchen | 252/305 |
| 1,455,378 | 5/1923 | Allen, Jr. . | |
| 1,878,254 | 9/1932 | Warren . | |

(List continued on next page.)

FOREIGN PATENT DOCUMENTS

| | | |
|---|---|---|
| 39 04 514 A1 | 8/1990 | (DE) . |
| 0 518 653 A1 | 12/1992 | (EP) . |
| 0 527 669 A1 | 2/1993 | (EP) . |

(List continued on next page.)

OTHER PUBLICATIONS

Manfred Wentz; *Textile Cleaning with Carbon Dioxide*?; Copyright© 1995 By R.R. Street & Co. Inc.

Abstract XP–002085400; NCSU College of Textiles' Researcher Develops Environmentally Sound $Co_2$ Dry Cleaning, *Southern Textile News,* 53(33:12):1 page, Aug. 25, 1997.

Abstract XP–002085399; DeSimone et al.; Design and Utilization of Surfactants for $CO_2$, 213$^{th}$ ACS National Meeting, Apr. 13–17, 1997.

Confidential Non–Disclosure Agreement Between MiCell Technologies, Inc. and Ted Williams, Jr., effective Feb. 13, 1998.

(List continued on next page.)

*Primary Examiner*—John Hardee

(57) ABSTRACT

The present invention provides a dry cleaning process that facilitates distribution of detergent and solvent and (optionally) facilitates recovery of cleaning by-products in conjunction with the cleaning of articles at a dry cleaning facility. The process comprises the steps of: (a) receiving from a source a dry cleaning solvent at the dry cleaning facility, the solvent consisting essentially of carbon dioxide; (b) receiving a concentrated detergent formulation (preferably a liquid formulation) at the cleaning facility; (c) accepting from customers soiled articles to be cleaned at the cleaning facility; (d) mixing the dry cleaning solvent and the concentrated detergent formulation to provide a dry cleaning formulation comprised of from 30 or 40 to 99 percent by weight of carbon dioxide solvent; (e) cleaning the articles in a cleaning apparatus to produce cleaned articles; (f) at least periodically distilling the dry cleaning formulation to produce a still residue comprising surfactant and soil; and then (g) returning the cleaned articles to the customers. Optionally but preferably, the process further comprises the step of: (h) returning the still residue to a waste collector or reprocessor for suitable disposal.

16 Claims, 4 Drawing Sheets

U.S. PATENT DOCUMENTS

| | | | |
|---|---|---|---|
| 2,074,508 | 3/1937 | Hetzer | 68/38 |
| 2,357,909 | 9/1944 | Ridge . | |
| 2,524,590 | 10/1950 | Boe | 252/305 |
| 2,816,429 | 12/1957 | Kurlancheek . | |
| 3,444,710 | 5/1969 | Gaugler et al. . | |
| 3,694,546 | 9/1972 | Roth et al. | 424/45 |
| 4,012,194 | 3/1977 | Maffei | 8/142 |
| 4,139,607 | 2/1979 | Simons et al. | 424/45 |
| 4,161,458 | 7/1979 | Kolleth | 252/305 |
| 4,219,333 | 8/1980 | Harris | 8/137 |
| 4,243,548 | 1/1981 | Heeb et al. | 252/305 |
| 4,912,793 | 4/1990 | Hagiwara | 8/158 |
| 4,970,093 | 11/1990 | Sievers et al. | 427/575 |
| 5,169,433 | 12/1992 | Lindsay et al. | 504/324 |
| 5,178,871 | 1/1993 | Thill | 525/405 |
| 5,267,455 | 12/1993 | Dewees et al. | 68/5 C |
| 5,279,615 | 1/1994 | Mitchell et al. | 8/142 |
| 5,301,664 | 4/1994 | Sievers et al. | 128/200.23 |
| 5,339,844 | 8/1994 | Stanford, Jr. et al. | 134/107 |
| 5,370,742 | 12/1994 | Mitchell et al. | 134/10 |
| 5,377,705 | 1/1995 | Smith, Jr. et al. | 134/95.3 |
| 5,412,958 | 5/1995 | Iliff et al. | 68/5 C |
| 5,431,843 | 7/1995 | Mitchell et al. | 252/186.38 |
| 5,467,492 | 11/1995 | Chao et al. | 8/159 |
| 5,486,212 | 1/1996 | Mitchell et al. | 8/142 |
| 5,651,276 | 7/1997 | Purer et al. | 68/5 C |
| 5,669,251 | 9/1997 | Townsend et al. | 68/58 |
| 5,676,705 | 10/1997 | Jureller et al. | 8/142 |
| 5,683,473 | 11/1997 | Jureller et al. | 8/142 |
| 5,683,977 | 11/1997 | Jureller et al. | 510/286 |
| 5,759,209 | 6/1998 | Adler et al. | 8/142 |
| 5,783,082 | 7/1998 | DeSimone et al. | 210/634 |
| 5,858,022 | 1/1999 | Romack et al. | 8/142 |
| 5,866,005 | 2/1999 | DeSimone et al. | 210/634 |
| 5,943,721 | 8/1999 | Lerette et al. | 8/158 |
| 5,944,996 | 8/1999 | DeSimone et al. | 210/634 |
| 5,970,554 | 10/1999 | Shore et al. | 8/158 |
| 6,098,430 | 8/2000 | McClain et al. | 68/18 R |
| 6,248,136 * | 6/2001 | McClain et al. | 8/142 |

FOREIGN PATENT DOCUMENTS

| | | |
|---|---|---|
| 0 732 154 A1 | 9/1996 | (EP) . |
| 0 828 020 A2 | 3/1998 | (EP) . |
| 0 828 020 A3 | 3/1998 | (EP) . |
| WO 94/01613 A | 1/1994 | (WO) . |
| WO 96/27704 | 9/1996 | (WO) . |
| WO 97/16264 | 5/1997 | (WO) . |
| WO 97/33031 | 9/1997 | (WO) . |
| WO 98/34595 | 8/1998 | (WO) . |
| WO 99/13148 | 3/1999 | (WO) . |

OTHER PUBLICATIONS

Correspondence, Letter from MiCell Technologies to Williams/Hangers Cleaners, signed Nov. 12, 1998 and Nov. 16, 1998.

Correspondence, Letter from Rudnick & Wolfe to Williams Cleaners (with attachments) regarding Franchise Agreement, dated Apr. 7, 1999.

Correspondence, Letter from Rudnick & Wolfe to Williams Cleaners regarding Franchise Agreement, dated Jun. 10, 1999.

Correspondence, Letter from MiCell Technologies to Williams Cleaners regarding Franchise Agreement for Wilmington, NC location, dated Sep. 22, 1999.

Acknowledgement By Prospective Franchisee, dated Aug. 19 (year unknown).

MiCell Technologies, Inc. Franchise Agreement with Lee-Bart Properties, LLC, dated Apr. 12, 1999, pp. 1–4.

Proclamation by Mayor of Wilmington, NC proclaiming Feb. 5, 1999, as Clean Water Day.

Article, N.C. Chemist Makes a Huge Bet On a New Dry–Cleaining Process, *Wall Street Journal* (Feb. 3, 1999).

Article, Safer dry cleaning machines make debut, Lexington, NC Dispatch (Feb. 3, 199).

Article, Environmentally safer dry cleaning machines make debut, *Raleigh NC News & Observer,* 2 pages (Feb. 3, 1999).

Article, Business and the Economy—Technology: Chemist Opens Enviro–Friendly Dry Cleaners, *Wall Street Journal Online* [Southeast Edition] (Feb. 4, 1999).

Article, 'Green' technique ready for dry cleaning debut, *The Charlotte Observer* (Feb. 4, 1999).

Article, Scientist launches green way to clean clothes, *University Gazette,* University of North Carolina at Chapel Hill, 2 pages (Feb. 10, 1999).

Article, Environmentally Friendly Cleaning Process and New Type of Radiation Sensor Win Awards, *Science Daily* (Sandy Hook, CT) *World Wide Web Edition,* 2 pages (Feb. 12, 1999).

Article, Three Rivers builds machine that could 'revolutionize' dry cleaning, *Midland Daily News,* Midland, MI (Feb. 12, 1999).

Article, Micell Launches Enviro–Friendly $Co_2$ Dry Cleaning Franchise in N.C., *Chemical Market Reporter* (Feb. 22, 1999).

Article, It's a first–try–cleaning process, *The News & Observer on the Web* (Feb. 25, 1999).

Article, Product may clean up cleaners, *News & Record,* Greensboro, NC, 2 pages (Feb. 6, 1999).

Article, New York Lends a Hand To Ailing 'Eco' Cleaners, *The New York Times,* 2 pages (Jan. 24, 1999).

* cited by examiner (Conventional Perc or Hydrocarbon Cleaning Process)

(Drywash™ $CO_2$ Cleaning Process)

(Integrated $CO_2$ Cleaning Process)

METHODS FOR CARBON DIOXIDE DRY CLEANING WITH INTEGRATED DISTRIBUTION

RELATED APPLICATIONS

This application is a divisional of U.S. application Ser. No. 09/497,823 now U.S. Pat. No. 6,248,136 entitled Methods for Carbon Dioxide Dry Cleaning with Integrated Distribution, filed on Feb. 3, 2000, the disclosure of which is hereby incorporated herein in its entirety by reference.

FIELD OF THE INVENTION

This invention relates to methods and systems for carbon dioxide dry cleaning that facilitate the simple distribution of ingredients, and optionally recovery of waste products.

BACKGROUND OF THE INVENTION

Organic solvents such as perchloroethylene and other low-pressure liquid solvents have long been popular for use in cleaning systems such as dry cleaning systems. As illustrated in FIG. 1, a dry cleaning facility employing these systems typically receives solvent and detergent from a supplier or suppliers, and garments or other articles to be cleaned from customers. Garments are returned to the customers, and some solvent escapes to the atmosphere. Lint, filter media, and other still residue (from the distillation of solvent on site) are classified as a hazardous waste and should be disposed of accordingly.

Recently, however, there are growing concerns that these solvents and by products may harm the environment and pose occupational safety hazards. These concerns have led to an extensive search for alternative solvents that are less hazardous and systems for applying such solvents. Some of this research has focused on systems utilizing solvents that are gases at low pressure. These systems may operate either under subcritical conditions such that the solvent is present as a liquid or under supercritical conditions such that the solvent is present as a supercritical fluid. Some of these systems utilize liquid carbon dioxide ($CO_2$) as a cleaning solvent.

One such carbon dioxide cleaning system is known as the Drywash™ system, illustrated in FIG. 2 herein. This system was developed by Hughes Environmental and Global Technologies Inc. In the Drywash™ dry cleaning system, the carbon dioxide is premixed with the necessary detergent formulations and shipped to the customer in bulk form. This approach is cumbersome because it requires shipping large volumes of detergent formulation, tends to increase the cost of the ingredients to the end user, does not permit the cleaning facility to utilize existing carbon dioxide distribution infrastructure, and is not conducive to franchising individual owners of dry cleaning facilities (which would facilitate widespread usage of the technology).

Accordingly, there is a need for alternative processes for implementing carbon dioxide dry cleaning techniques.

SUMMARY OF THE INVENTION

In the present invention, a carbon dioxide dry cleaning process is carried out in which a concentrated detergent formulation is mixed at the site of the cleaning facility with carbon dioxide. The concentrated detergent formulation preferably includes a cosolvent that makes possible the easy mixing of the concentrated detergent formulation. By facilitating the mixing of a concentrated detergent formulation with the carbon dioxide solvent at the cleaning facility, the present invention makes possible the separate shipping of the carbon dioxide to the cleaning facility. Thus, any convenient source of carbon dioxide can be used at the cleaning facility, including but not limited to beverage grade carbon dioxide (currently distributed for soda fountain use), carbon dioxide produced for industrial purposes, etc.

Accordingly, the present invention provides a dry cleaning process that facilitates distribution of detergent and solvent and (optionally) facilitates recovery of cleaning by-products in conjunction with the cleaning of articles at a dry cleaning facility. The process comprises the steps of:

(a) receiving from a source a dry cleaning solvent at the dry cleaning facility, the solvent consisting essentially of carbon dioxide;

(b) receiving a concentrated detergent formulation (preferably a liquid formulation) at the cleaning facility;

(c) accepting from customers soiled articles to be cleaned at the cleaning facility;

(d) mixing the dry cleaning solvent and the concentrated detergent formulation to provide a dry cleaning formulation comprised of from 30 or 40 to 99 percent by weight of carbon dioxide solvent;

(e) cleaning the articles in a cleaning apparatus to produce cleaned articles;

(f) at least periodically distilling the dry cleaning formulation to produce a still residue comprising surfactant and soil; and then (g) returning the cleaned articles to the customers. Optionally but preferably, the process further comprises the step of:

(h) returning the still residue to a waste collector or reprocessor for suitable disposal (e.g., for incineration, for reclamation, e.g.. of the detergents contained therein, and or for recycling, with recycling including burning the residue with energy recovery).

The process may be implemented at a plurality of cleaning facilities, each of which can receive the concentrated detergent formulation from a common source or supplier, and each of which may receive the dry cleaning solvent from a common or different source or supplier, which may be the same as or different from the concentrated detergent formulation supplier. Likewise, he plurality of cleaning facilities may return the sill residue to a common or different waste reprocessor.

The present invention is explained in greater detail in the drawings herein and the specification set forth below.

DETAILED DESCRIPTION OF PREFERRED EMBODIMENTS

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

The term "clean" as used herein refers to any removal of soil, dirt, grime, or other unwanted material, whether partial or complete. The invention may be used to clean nonpolar stains (i.e., those which are at least partially made by nonpolar organic compounds such as oily soils, sebum and the like), polar stains (i.e., hydrophilic stains such as grape juice, coffee and tea stains), compound hydrophobic stains (i.e., stains from materials such as lipstick and candle wax), and particulate soils (i.e., soils containing insoluble solid components such as silicates, carbon black, etc.). Articles that can be cleaned by the method of the present invention are, in general, garments and fabrics (including woven and non-woven) formed from materials such as cotton, wool, silk, leather, rayon, polyester, acetate, fiberglass, furs, etc., formed into items such as clothing, work gloves, rags, leather goods (e.g., handbags and brief cases), etc.

Figure 1:
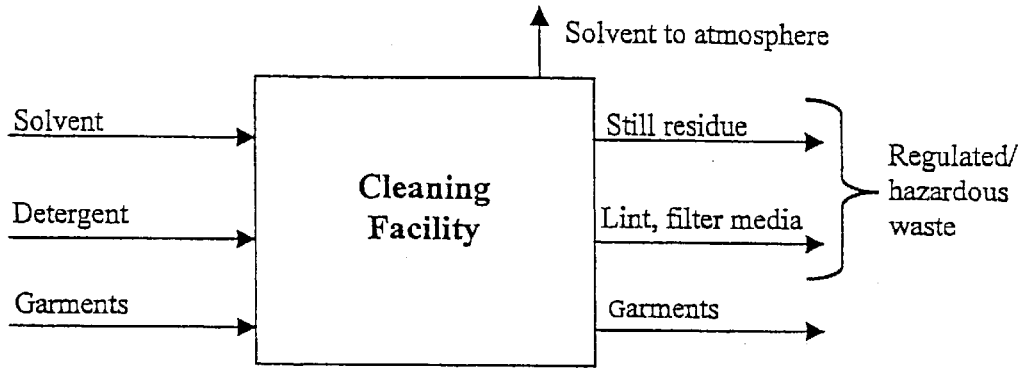
FIG. 1 (prior art) illustrates a conventional dry cleaning facility employing perchlorethylene ("perc") or organic solvent cleaning processess, in which still residue, lint, filter media and the like are treated as a hazardous waste.
Figure 2:
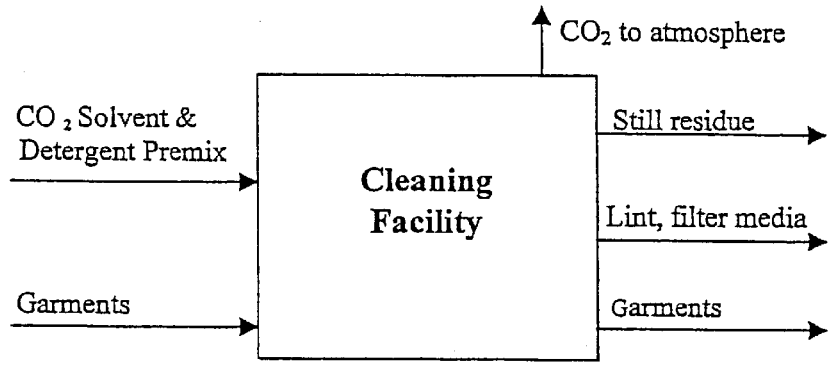
FIG. 2 (prior art) illustrates a carbon dioxide cleaning facility incorporating the current Drywash™carbon dioxide cleaning system, in which the carbon dioxide and detergent formulations are premixed and sold to the dry cleaning facility or user as a premixed solution.
Figure 3:
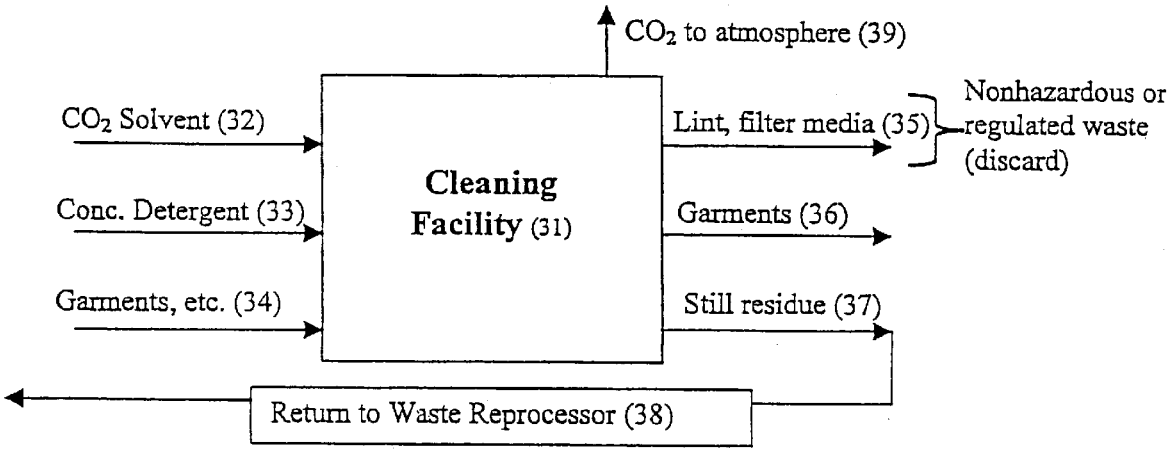
FIG. 3 illustrates a carbon dioxide cleaning process of the invention in which the $CO_2$ is supplied to the cleaning facility separately from the detergent, and in which still residue is returned to a central reprocessor (typically for incineration).

As illustrated by FIG. 3, in the present invention the process, as implemented at a particular cleaning facility 31, involves receiving from a source a dry cleaning solvent 32, the solvent consisting essentially of carbon dioxide, and receiving from the same or different source a concentrated detergent formulation 33 (preferably a liquid formulation). The concentrated detergent formulation preferably includes a cosolvent, as explained in greater detail below. The cleaning facility accepts from customers soiled articles such as garments 34 to be cleaned. The dry cleaning solvent and the concentrated detergent formulation are mixed at the cleaning facility, preferably in the cleaning apparatus (but optionally in a separate mixing vessel, the contents of which then transferred to the cleaning apparatus), to provide a dry cleaning formulation comprised of from 30 or 40 to 99 percent by weight of carbon dioxide solvent. The articles are then cleaned in the cleaning apparatus to produce cleaned articles 36, which are returned to the customers. Lint, filter media, land other by products 35, may be discarded as nonhazardous waste, and still residue 37, created by at least periodically (e.g., intermittently or continuously) distilling the dry cleaning formulation to recover carbon dioxide and produce a still residue comprising surfactant and soil; may be returned to a waste reprocessor 39 for appropriate disposal (e.g., for incineration).

Preferably, the concentrated detergent formulation comprises from 5 to 95 percent by weight of cosolvent (typically an organic cosolvent), and the dry cleaning formulation comprises from 0.1 to 60 or 80 percent by weight of the cosolvent.

In addition, the concentrated detergent formulation preferably comprises from 5 to 95 percent by weight of surfactant, and the dry cleaning formulation comprises from 0.1 to 10 percent by weight of the surfactant.

Advantageously, the concentrated detergent formulation may be received by the cleaning facility in a container, and the still residue is returned to the waste reprocessor in the same the container (e.g., a 1 or 5 to 55 or 100 gallon container). This facilitates handling of all cleaning constituents and by-products entering and leaving the cleaning facility, and facilitates the maintenance of a clean, orderly work environment at the cleaning facility.

To further reduce the amount of cleaning constituents or ingredients entering the cleaning facility, it is preferred that not more than 5 or even 2 percent by weight of the carbon dioxide solvent in the cleaning apparatus be lost to the atmosphere during each cleaning cycle (i.e., each, loading of a wash vessel in a cleaning apparatus with articles to be cleaned, closing of the vessel and washing of the contents, and subsequent opening and removal of the cleaned articles). This may be achieved by any suitable technique, such as the vapor recovery procedures described below. Liquid dry-cleaning formulations or compositions useful for carrying out the present invention include, but are not limited to, those described in U.S. Pat. No. 5,858,022 and commonly owned, copending U.S. Pat. application Ser. No. 09/234,145 (Filed Jan. 19, 1999), the disclosures of which are incorporated by reference herein in their entirety. Such compositions typically comprise:

(a) from 0 or 0.1 to 10 percent (more preferably from 0.1 to 4 percent) water (which may be introduced into the composition by addition to the formulation, or carried into the composition in or on the articles to be cleaned);

(b) carbon dioxide (to balance; typically at least 30 percent);

(c) surfactant (preferably from 0.01, 0.1 or 0.5 percent to 5 or 10 percent); and (d) from 0.1 to 50 percent (more preferably 4 to 30 percent) of an organic co-solvent. Percentages herein are expressed as percentages by weight unless otherwise indicated.

The concentrated detergent formulation will not include carbon dioxide, but will typically include the other of the aforesaid ingredients in appropriate proportion to provide or produce the carbon dioxide dry cleaning formulation when mixed with carbon dioxide at the cleaning facility The dry cleaning composition is provided in liquid form at ambient, or room, temperature, which will generally be between zero and 50° Centigrade. The composition is held at a pressure that maintains it in liquid form within the specified temperature range. The cleaning step is preferably carried out with the composition at ambient temperature.

The organic co-solvent is, in general, a hydrocarbon co-solvent. Typically the co-solvent is an alkane co-solvent, with $C_{10}$ to $C_{20}$ linear, branched, and cyclic alkanes, and mixtures thereof (preferably saturated) currently preferred. The organic co-solvent preferably has a flash point above 140° F., and more preferably has a flash point above 170° F. The organic co-solvent may be a mixture of compounds, such as mixtures of alkanes as given above, or mixtures of one or more alkanes in combination with additional compounds such as one or more alcohols (e.g., from 0 or 0.1 to 5% of a C1 to C15 alcohol (including diols, triols, etc.)). Biodegradable cosolvents are, in general, natural oils such as seed oils (cottonseed, canola,) corn oil, soybean oil, etc., which may utilized in their naturally occurring or modified form.

Any surfactant can be used to carry out the present invention, including both surfactants that contain a $CO_2$-philic group (such as described in PCT Application WO96/27704) linked to a $CO_2$-phobic group (e.g., a lipophilic group) and surfactants that do not contain a $CO_2$-philic group (i.e., surfactants that comprise a hydrophilic group linked to a hydrophobic (typically lipophilic) group). A single surfactant may be used, or a combination of surfactants may be used. Numerous surfactants are known to those skilled in the art. See, e.g., McCutcheon's Volume 1: Emulsifiers & Detergents (1995 North American Edition) (MC Publishing Co., 175 Rock Road, Glen Rock, N.J. 07452). Examples of the major surfactant types that can be used to carry out the present invention include the: alcohols, alkanolamides, alkanolamines, alkylaryl sulfonates, alkylaryl sulfonic acids, alkylbenzenes, amine acetates, amine oxides, amines, sulfonated amines and amides, betaine derivatives, block polymers, carboxylated alcohol or alkylphenol ethoxylates, carboxylic acids and fatty acids, a diphenyl sulfonate derivatives, ethoxylated alcohols, ethoxylated alkylphenols, ethoxylated amines and/or amides, ethoxylated fatty acids, ethoxylated fatty esters and oils, fatty esters, fluorocarbon-based surfactants, glycerol esters, glycol esters, hetocyclic-type products, imidazolines and imidazoline derivatives, isethionates, lanolin-based derivatives, lecithin and lecithin derivatives, lignin and lignin derivatives, maleic or succinic anhydrides, methyl esters, monoglycerides and derivatives, olefin sulfonates, phosphate esters, phosphorous organic derivatives, polyethylene glycols, polymeric (polysaccharides, acrylic acid, and acrylamide) surfactants, propoxylated and ethoxylated fatty acids alcohols or alkyl phenols, protein-based surfactants, quaternary surfactants, sarcosine derivatives, silicone-based surfactants, soaps, sorbitan derivatives, sucrose and glucose esters and derivatives, sulfates and sulfonates of oils and fatty acids, sulfates and sulfonates ethoxylated alkylphenols, sulfates of alcohols, sulfates of ethoxylated alcohols, sulfates of fatty esters, sulfonates of benzene, cumene, toluene and xylene, sulfonates of condensed naphthalenes, sulfonates of dodecyl and tridecylbenzenes, sulfonates of naphthalene and alkyl naphthalene, sulfonates of petroleum, sulfosuccinamates, sulfosuccinates and derivatives, taurates, thio and mercapto derivatives, tridecyl and dodecyl benzene sulfonic acids, etc.

As will be apparent to those skilled in the art, numerous additional ingredients can be included in the dry-cleaning composition, including detergents, bleaches, whiteners, softeners, sizing, starches, enzymes, hydrogen peroxide or a source of hydrogen peroxide, fragrances; etc.

In practice, in a preferred embodiment of the invention, an article to be cleaned and a liquid dry cleaning composition as given above are combined in a closed drum or "wash vessel". The liquid dry cleaning composition is preferably provided in an amount so that the closed drum contains both a liquid phase and a vapor phase (that is, so that the drum is not completely filled with the article and the liquid composition). The article is then agitated in the drum, preferably so that the article contacts both the liquid dry cleaning composition and the vapor phase, with the agitation carried out for a time sufficient to clean the fabric. The cleaned article is then removed from the drum. The article may optionally be rinsed (for example, by removing the composition from the drum, adding a rinse solution such as liquid $CO_2$ (with or without additional ingredients such as water, co-solvent, etc.) to the drum, agitating the article in the rinse solution, removing the rinse solution, and repeating as desired), after the agitating step and before it is removed from the drum. The dry cleaning compositions and the rinse solutions may be removed from the wash vessel by any suitable means, including both draining and venting.

Figure 4:
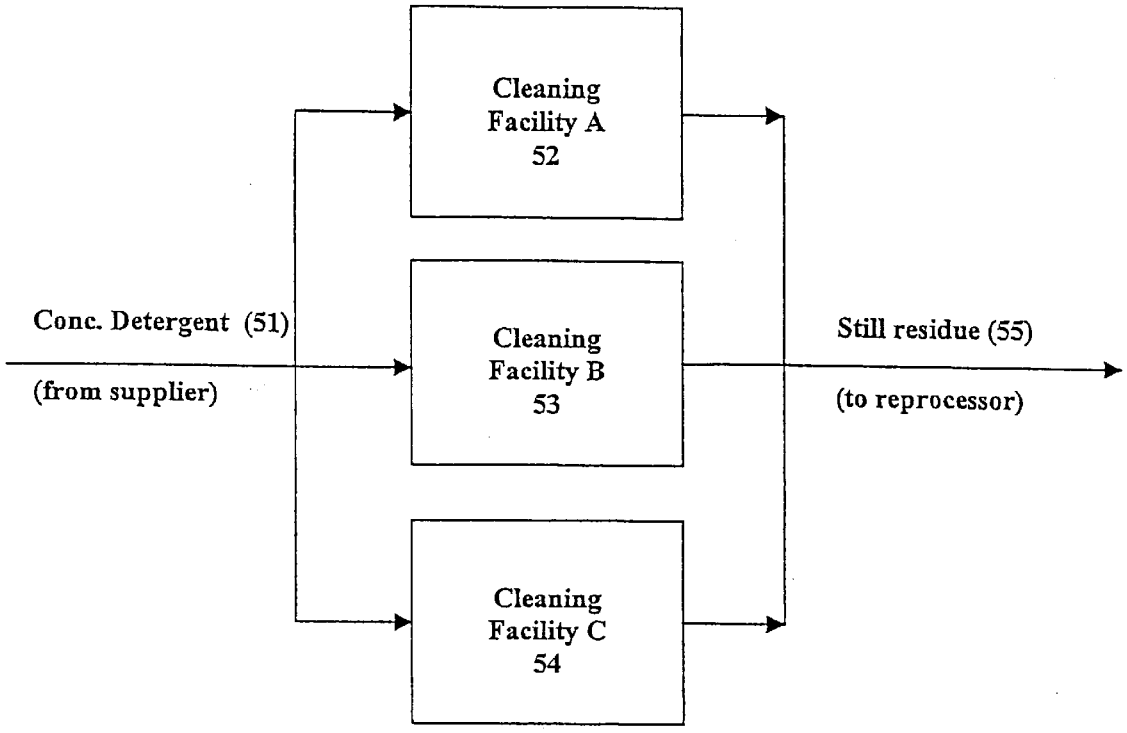
FIG. 4 illustrates a process of the present invention implemented at a plurality of cleaning facilities.

FIG. 4 illustrates a process of the present invention implemented at a plurality of cleaning facilities designated A, B, and C (52, 53, 54). The concentrated detergent formulation 51 is distributed from a common supplier to each of the cleaning facilities, and the still residue 55 may be returned to a waste reprocessor, who may be the same or different for each cleaning facility. The concentrated detergent formulation may be shipped in relatively small containers as described above, which need not be pressurized or maintained at high pressure. If desired, still residue 55 may be returned to a waste collector as described above (which may be the same or different for each cleaning facility) in the same containers in which the concentrated detergent formulation 51 Each cleaning facility may obtain carbon dioxide from a common source or a separate source as described below, and the carbon dioxide need not be premixed with the detergent formulation prior to shipping to the cleaning facility. Thus, by providing a standardized carbon dioxide dry-cleaning system (i.e., one that can be carried out with the same methods, apparatus, and instructions and operating procedures at a plurality of different cleaning facilities), which can be implemented in a manner that facilitates the maintenance of a clean and orderly workplace at the cleaning facility, the system can be franchised to a plurality of different owners, thus facilitating the widespread use and acceptance of the methods and processes described herein. The term "franchise" as used herein has its conventional meaning, in which the franchisor develops a standardized dry cleaning process as described herein, typically including standardized operating instructions which are recorded in written form , which process and instructions are then supplied to the franchisee who builds, purchases or otherwise establishes the individual cleaning facility, pursuant to a contract (e.g., a fixed term renewable contract) between the franchisor and the franchisee.

Figure 5:
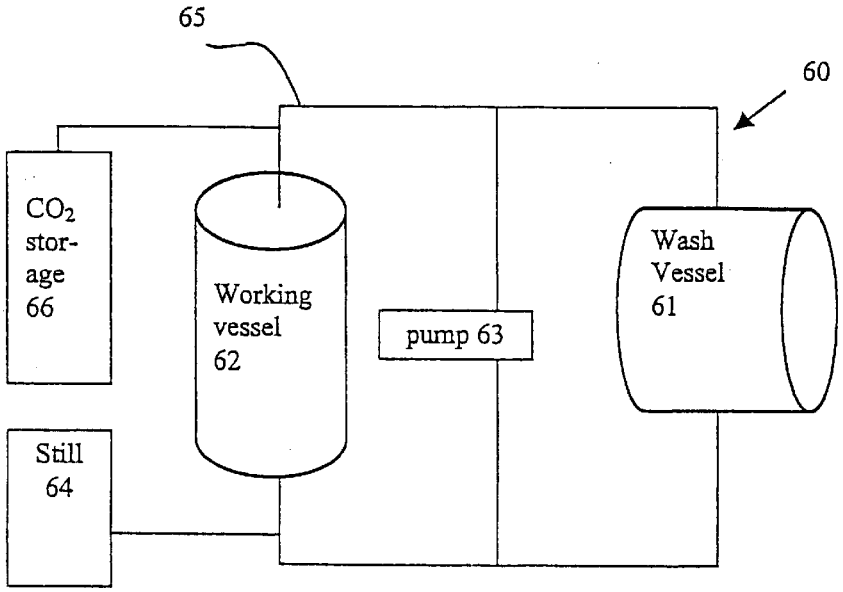
FIG. 5 schematically illustrates a carbon dioxide cleaning method and apparatus that may be implemented in a dry cleaning facility to carry out the present invention.

As generally illustrated in FIG. 5, any suitable carbon dioxide cleaning apparatus may be employed at the cleaning facility. In general, such apparatus includes a wash vessel 61, a working vessel 62, a pump 63, and a still 64. System piping, generally illustrated as 65 (a variety of piping arrangements may be employed) is included with appropriate valves and controls (not shown) to provide fluid communication between the necessary components. The cleaning formulation is typically stored in the working vessel 62 between cleaning cycles, and pumped into the wash vessel 61 by pump 63 during the wash cycle. When the cleaning formulation has been used and accumulates dirt, soil, etc., the formulation can be distilled in still 64 to provide distilled carbon dioxide, which is preferably returned to the system, and a still residue which is discarded as described herein. Filters, compressors for vapor recovery, pumps for the addition of the concentrated detergent formulation into the system (i.e., into the working vessel, or into a line of the system piping), may also be included.

While the carbon dioxide may be delivered in any form, in a preferred embodiment, the carbon dioxide is delivered to a storage tank 66 located on site at the cleaning facility, which storage tank contains the carbon dioxide as a cryogenic gas. This facilitates delivery of carbon dioxide solvent from existing distributors, such as those in place for the beverage industry.

While a horizontal wash vessel, or drum, is illustrated in FIG. 5, both horizontal drum and vertical drum apparatus may be employed. When the drum is a horizontal drum, the agitating step is carried out by simply rotating the drum. When the drum is a vertical drum it typically has an agitator positioned therein, and the agitating step is carried out by moving (e.g., rotating or oscillating) the agitator within the drum. A vapor phase may be provided by imparting sufficient shear forces within the drum to produce cavitation in the liquid dry-cleaning composition. Finally, in an alternate embodiment of the invention, agitation may be imparted by means of jet agitation as described in U.S. Pat. No. 5,467,492 to Chao et al., the disclosure of which is incorporated herein by reference. As noted above, the liquid dry cleaning composition is preferably an ambient temperature composition, and the agitating step is preferably carried out at ambient temperature, without the need for associating a heating element with the cleaning apparatus. Other dry cleaning apparatus that can be used to carry out the present invention include, but are not limited to, those disclosed in U.S. Pat. No. 5,267,455 to Dewees et al; U.S. Pat. No. 5,683,977 to Jureller et al; U.S. Pat. No. 5,970,554 to Shore et al; and PCT Application WO97/33031 to Taricco, the disclosures of all U.S. Patent references of which are to be incorporated herein by reference.

Any suitable technique and apparatus can be used to add detergent to the carbon dioxide, including but not limited to those described in commonly owned, copending patent application entitled Detergent Injection Systems for Carbon Dioxide Cleaning Apparatus, Ser. No. 09/312,556 (filed May 14, 1999), the disclosure of which is incorporated herein by reference. For example, one system for the controlled addition of detergent formulations and the like to a carbon dioxide cleaning apparatus comprises: (a) a high pressure wash vessel; (b) an auxiliary vessel; (c) a drain line connecting said auxiliary vessel to said wash vessel; (d) a vent line connecting said auxiliary vessel to said wash vessel; (e) a detergent reservoir; and (f) a detergent supply line connecting said detergent reservoir to said auxiliary vessel.

An alternate system for the addition of aqueous detergent formulations and the like to a carbon dioxide dry cleaning system under turbulent conditions comprises: (a) a high pressure wash vessel; (b) a filter; (c) a carbon dioxide cleaning solution drain line interconnecting said wash vessel to said filter; (d) a carbon dioxide cleaning solution supply line connecting said filter to said wash vessel; (e) a first high pressure pump operably connected to said drain line; (f) a detergent formulation reservoir; (g) a detergent formulation supply line connecting said reservoir to said carbon dioxide cleaning solution supply line; and (h) a second high pressure pump operably connected to said detergent formulation supply line for transferring detergent formulation from said detergent formulation reservoir into said carbon dioxide cleaning solution under turbulent conditions.

Of course, other systems for adding detergent can be employed, such as combining the carbon dioxide and the detergent formulation in a separate mixing vessel, and then transferring the mixed formulation to a cleaning apparatus. In addition, it will be appreciated that, once the cleaning formulation is prepared, other ingredients can be added, and additional constituent ingredients added or adjusted, in the course of ordinary operating procedures.

Figure 6:
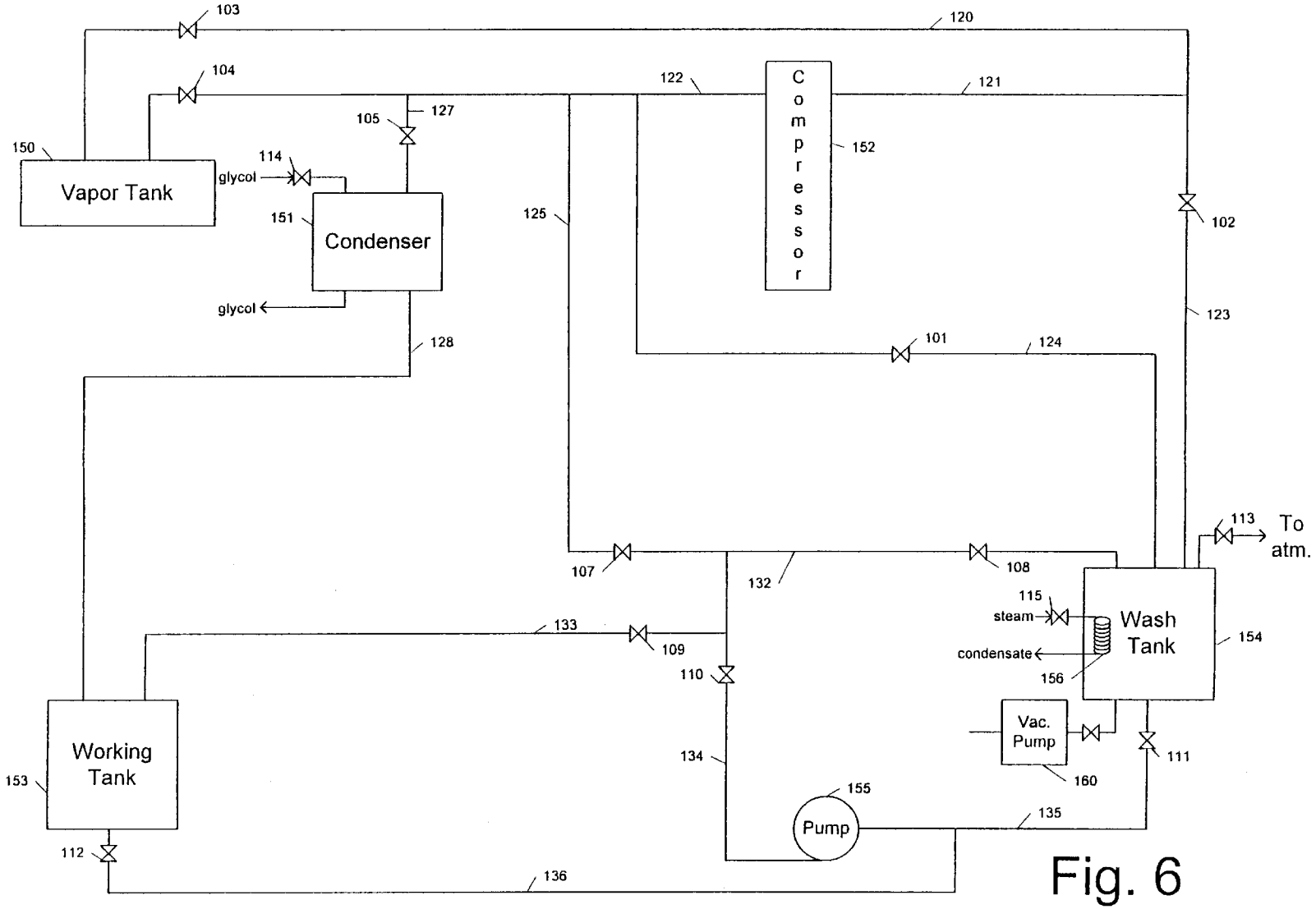
FIG. 6 illustrates a preferred carbon dioxide dry cleaning, system employing an optional vapor tank that may be used to carry out the present invention.
Figure 7:
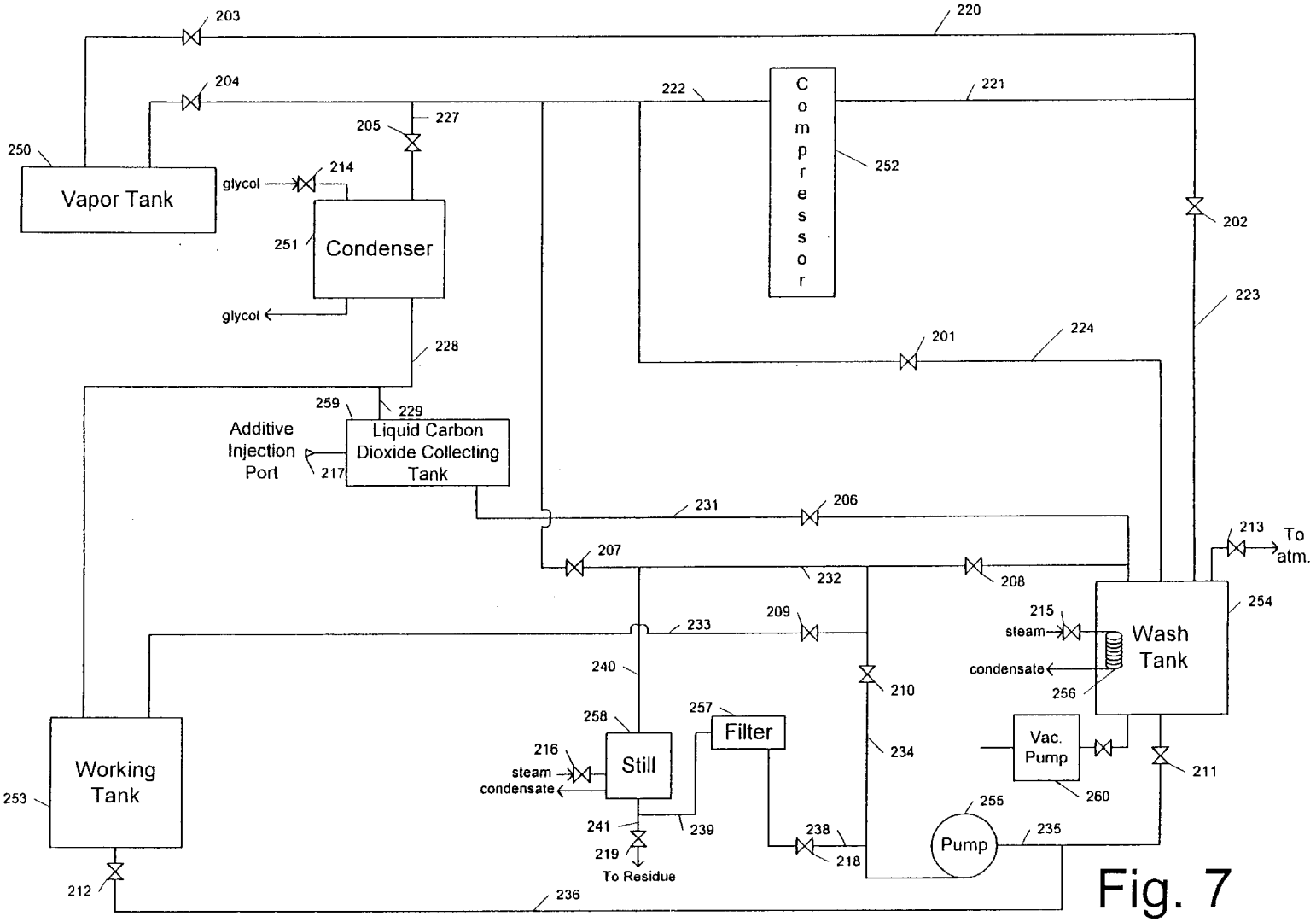
FIG. 7 illustrates a carbon dioxide dry cleaning, system employing optional vapor tank and an optional liquid carbon dioxide collecting tan that may be used to carry out the present invention.

A particular system and apparatus for carrying out dry cleaning with carbon dioxide is illustrated in FIGS. 6–7. While method and apparatus employs a vapor recovery feature to reduce carbon dioxide escape to the atmosphere during each cleaning cycle, it will be appreciated that such vapor recovery is preferred but not mandatory in carrying out the present invention.

Referring first to FIG. 6, a wash cycle will be described, focusing particularly on charging carbon dioxide vapor into and removing carbon dioxide vapor from wash tank 154. In general, a wash cycle may be performed in the following steps: (1) placing clothes to be cleaned into wash tank 154; (2) removing air from the wash tank through vacuum pump 160; (3) charging carbon dioxide vapor into wash tank 154 to pressurize it; (4) transferring liquid cleaning solution, comprising liquid carbon dioxide as a solvent, from working tank 153 to wash tank 154 via pump 155; (5) washing clothes in wash tank 154; (6) draining liquid cleaning solution from wash tank 154 and transferring liquid cleaning solution via pump 155 back to working tank 153; (7) extracting remaining liquid cleaning solution from clothes in wash tank 154; (8) removing carbon dioxide vapor from wash tank 154 to depressurize it; and (9) removing clean clothes from wash tank 154. For illustrative purposes, this description will begin in the middle of a wash cycle, at the washing step, and end at the washing step in the next wash cycle. Valves 101–115 are shut, compressor 152 and pump 155 are secured, and system pressure and temperature are at or near saturated conditions for the given cleaning solution, preferably between about 55 to 62° F. (10 to 17° C.) at between about 681 to 756 psig for a carbon dioxide based system. One who is skilled in the art will understand that carbon dioxide dry cleaning systems can be operated at a variety of pressures and temperatures.

After washing clothes in wash tank 154 for a sufficient amount of time, the liquid cleaning solution may be drained from wash tank 154 by opening valves 109, 110, 111, 101, and 105 starting pump 155, which transfers the liquid cleaning solution from wash tank 154 through lines 135, 134, and 133 back to working tank 153. Once the liquid cleaning solution is transferred, pump 155 is secured and valves 109, 110, 111, 101, and 105 are shut. One who is skilled in the art will appreciate that lines may be selected from a group comprising piping, conduit, and other means of fluid communication that can withstand system temperature and pressure. Piping for the system is preferably schedule 40, stainless steel, and conforms to ANSI standards B31.3. One who is skilled in the art will also understand that a piping system may be comprised of one or more lines and that zero or more valves may reside in the one or more lines.

Any remaining liquid cleaning solution may be mechanically or otherwise extracted from the clothes in wash tank 154, and the remaining liquid cleaning solution may be drained from wash tank 154 using the drain procedure outlined above. At this point, the atmosphere in wash tank 154 is comprised primarily of carbon dioxide vapor.

Once the liquid cleaning solution has been drained, the carbon dioxide vapor in wash tank 154 may be removed to a vapor tank as follows, depressurizing wash tank 154 and allowing clean clothes to be removed. Valves 101 and 104 are opened, allowing the carbon dioxide vapor to move from wash tank 154 through lines 124 and 122 to vapor tank 150. Vapor tank 150 preferably has a volume of about 6 to about 60 $ft^3$ (about 0.17 to about 1.7 $m^3$). One skilled in the art will be able to select appropriate tanks to withstand system pressure and temperature by using, for example, the ASME Pressure Vessel Code. Valve 101 and line 124 may be sized to provide adequate restriction to the vapor flow to limit the velocity of this gas stream when the differential pressure between wash tank 154 and vapor tank 150 is at its greatest, about 700 psig or greater. Valve 101 is preferably a ½" full-flow ball valve, model #8450 commercially available from Watts Regulator Company of N. Andover, Mass. Line 124 is preferably a 1"schedule 40, stainless steel pipe conforming to ANSI standards B31.3. One who is skilled in the art could select a suitable valve to limit the flow rate resulting from other pressure differentials.

When this differential pressure has been reduced sufficiently, preferably less than 200 psi differential, valves 102 and 103 may be opened to facilitate vapor transfer by providing an additional flow path through lines 123 and 121. When the pressure differential between wash tank 154 and vapor tank 150 has been reduced such that it is less then about 100 psig, preferably less than about 50 psig, more preferable at or near zero, valves 101 and 103 are shut and compressor 152 is started. Compressor 152 pumps carbon dioxide vapor from wash tank 154 through lines 123, 121, and 122 to vapor tank 150. When the pressure in wash tank 154 is at or near atmospheric pressure, preferably less than about 100 psig, more preferably less than about 50 psig, compressor 152 is secured and valves 102 and 104 are shut. Any vapor remaining in wash tank 154 may be vented through valve 113. Wash tank 154 is now depressurized and clean clothes may be removed from it.

As just described, draining a solution comprising liquid carbon dioxide out of wash tank 154 may result in carbon dioxide vapor remaining in wash tank 154. Removing most if not all of this carbon dioxide vapor to a vapor tank rather than condensing it to liquid carbon dioxide conserves the carbon dioxide vapor for reuse in charging wash tank 154 at the beginning of a cycle. Thus, use of the vapor tank may eliminate the need for a condenser and may reduce the capital and operating costs of the cleaning system. Furthermore, conserving the carbon dioxide vapor for reuse in charging the wash tank at the beginning of a cycle may improve the thermodynamic efficiency of the system. Additionally, which may reduce or eliminate the need to remove air from the system at the beginning of each wash cycle. Thus, the need for a vacuum pump may be reduced or even eliminated resulting in lower capital costs and operating expenses. Furthermore, higher concentrations of air in the system may increase the efficiency of the system by providing a partial pressure in the head-space of the working tank, resulting in increased net positive suction head for a pump.

While compressor 152 may be used to remove all or almost all of the carbon dioxide vapor from wash tank 154 as just described, this process may be somewhat inefficient. As the pressure in vapor tank 150 builds, the compressor 152 reaches high compression ratios and the vapor transfer rate through compressor 152 decreases. Thus, compressor 152 may have to run for a long time to remove all or nearly all of the vapor from wash tank 154, resulting in energy and time inefficiencies. The vapor removal step described above may be augmented to utilize condenser 151, partially if not completely eliminating these inefficiencies by reducing the pressure in vapor tank 150 as follows. When the pressure differential between wash tank 154 and vapor tank 150 has been reduced sufficiently, preferably less than about 100 psig, more preferably less than 50 psig, most preferably at or near zero, valves 101 and 104 are shut and compressor 152 is started. Valve 114 is opened and condenser 151 is brought on-line. The remaining vapor in wash tank 154 is transferred through lines 123, 121, and 122 to vapor tank 150. Valve 105 is opened and some of the vapor flowing through line 122 begins to flow through line 127, condense in condenser 151, and flow as liquid through line 128 into working tank 153. When the pressure in wash tank. 154 is at or near atmospheric pressure, preferably less than about 100 psig, most preferably less than about 50 psig, compressor 152 is secured and valves 102, 104, 105, and 114 are shut. Any vapor remaining in wash tank 154 may be vented through valve 113. Wash tank 154 is now depressurized and clean clothes may be removed from it.

A condenser must be sized to provide sufficient cooling during peak load conditions. By utilizing condenser 151 to condense only a portion of the carbon dioxide vapor removed from wash tank 154 rather than all or almost all of the vapor, the size of condenser 151 may be drastically reduced because the peak load experienced by the condenser has been drastically reduced. This embodiment may therefore result in lower capital and operating costs.

As carbon dioxide vapor is removed from wash tank 154 as described above, the temperature within wash tank 154 may decrease as the vapor expands. This temperature decrease may cause frozen carbon dioxide, commonly known as dry ice, to form on the clothes in wash tank 154. To reduce or eliminate this cooling effect, it may be desirable to heat the contents of wash tank 154 as the vapor is removed. Heat is preferably supplied using heating element 156 by opening valve 115; however, one skilled in the art will know other ways of providing heat to wash tank 154.

At the beginning of the next wash cycle, clothes to be cleaned may be placed into wash tank 154, which is at atmospheric pressure. As mentioned above, the cleaning solution in working tank 154 is at or near saturated conditions, preferably between about 55 to 62° F. (10 to 17° C.) at between about 681 to 756 psig for a carbon dioxide based system. The pressure differential between working tank 153 and wash tank 154, roughly 700 psig, may be reduced to facilitate safely transferring liquid cleaning solution to wash tank 154 by charging conserved carbon dioxide vapor from vapor tank 150 into wash tank 154 to pressurize it.

Wash tank 154 may be pressurized by charging the conserved carbon dioxide vapor from vapor tank 150 to wash tank 154 as follows. Valves 104 and 101 are opened, allowing vapor to move from vapor tank 150 through lines 122 and 124 to wash tank 154. Valve 101 and line 124 may be sized to provide adequate restriction to the vapor flow to limit the velocity of this gas stream when the differential pressure between vapor tank 150 and wash tank 154 is at its greatest. When this differential pressure has been reduced sufficiently, preferably less than 200 psi differential, valves 103 and 102 may be opened to facilitate vapor transfer by providing an additional flow path through lines 121 and 123. When the pressure differential between wash tank 154 and vapor tank 150 has been reduced such that it is at or near zero, valves 104 and 102 are shut and compressor 152 is started. Compressor 152 pumps conserved carbon dioxide vapor from vapor tank 150 through lines 121, 121, and 124 to wash tank 154 until the differential pressure between working tank 153 and wash tank 154 has been reduced such that it is less than about 300 psig, preferably less than 200 psig, more preferably less than or equal to 100 psig. Then, compressor 152 is secured and valves 103 and 101 are shut. Alternatively, only valve 101 could be shut, keeping valve 103 open and compressor 152 running to facilitate transfer of cleaning solution from the working tank 153 to wash tank 154 as described below. Wash tank 154 has now been pressurized such that the differential pressure between wash tank 154 and working tank 153 is at or near zero and cleaning solution may be transferred safely from working tank 153 to wash tank 154.

Charging conserved carbon dioxide vapor from vapor tank 150 to wash tank 154 rather than generating vapor by vaporizing cleaning solution in an evaporator, still, or storage tank may eliminate the need for an evaporator, a still, or a heating element in the storage tank. Thus, the present invention may reduce capital costs and operating expenses and may be more thermodynamically efficient.

While compressor 152 may be used to pump the remaining conserved carbon dioxide vapor from vapor tank 150 to pressurize wash tank 154 as just described, this process may be somewhat inefficient. As the pressure in wash tank 154 builds, the compressor 152 reaches high compression ratios and the vapor transfer rate through compressor 152 decreases. Thus, compressor 152 may have to run for a long time to pressurize wash tank 154 completely or nearly completely, resulting in energy and time inefficiencies. The vapor charging step described above may be augmented as follows, partially if not completely eliminating these inefficiencies. When the pressure differential between wash tank 154 and vapor tank 150 has been reduced such that it is at or near zero, valves 104 and 102 are shut and compressor 152 is started. Compressor 152 pumps conserved carbon dioxide vapor from vapor tank 150 through lines 121, 121, and 124 to wash tank 154. When compressor 152 begins to reach high compression ratios, valve 105 is opened. Vapor pressure in working tank 153 drops and cleaning solution in working tank 153 begins to boil. Vapor from working tank 153 flows through line 128, through condenser 151 which is off-line, and through line 127 where this vapor joins the flow of vapor in line 122 coming from the compressor 152 and flows into the wash tank through line 124. When the differential pressure between working tank 153 and wash tank 154 has been reduced such that it is at or near zero, compressor 152 is secured and valves 103, 105, and 101 are shut. Wash tank 154 has now been pressurized such that the differential pressure between wash tank 154 and working tank 153 is at or near zero and cleaning solution may be transferred safely from working tank 153 to wash tank 154.

By supplying only a portion rather than all of the carbon dioxide vapor by vaporizing the cleaning solution in working tank 153, the heat that must be supplied to the cleaning solution to make-up for heat lost due to vaporization may be reduced. Thus, the present invention may reduce capital costs and operating expenses and may be more thermodynamically efficient.

Cleaning solution may be transferred from working tank 153 to wash tank 154 by opening valves 112, 110, 108, 101, and 105 and starting pump 155. Cleaning solution moves from working tank 153 through lines 136, 135, 134, and 132 into wash tank 154. When a sufficient amount of cleaning solution has been transferred, pump 155 is secured and valves 112, 110, 108, 101, and 105 are shut. While cleaning solution is being transferred from working tank 153 to wash tank 154, the pressure in vapor tank 150 may be reduced by opening valves 103 and 105, bringing condenser 151 on-line by opening valve 114 and starting compressor 152. This pressure may be reduced to better prepare vapor tank 150 to receive vapor during the next cycle. When pressure in vapor tank 150 has been reduced to preferably less than 100 psig, most preferably less than 50 psig, compressor 152 is secured and valves 103, 105, and 114 are shut.

Alternatively, cleaning solution may be transferred using compressor 152 instead of pump 155. To accomplish this transfer, compressor 152 is allowed to continue running after the differential pressure between vapor tank 150 and wash tank 154 has been reduced such that it is at or near zero. When the outlet pressure of compressor 152 is slightly higher than the pressure in working tank 153, valve 101 is shut and valve 105 is opened such that the outlet pressure from compressor 152 pressurizes the vapor space in working tank 153. Of course, condenser 151 is not providing cooling to the vapor in line 127 because valve 114 is closed. With working tank 153 now under additional pressure, valves 112 and 111 are opened. Cleaning solution is transferred from working tank 153 to wash tank 154 through lines 136 and 135. When a sufficient amount of cleaning solution has been transferred, compressor 152 is secured and valves 112, 111, 105, and 103 are shut. Washing clothes in wash tank 154 is commenced.

Similarly, solution may be transferred from wash tank 154 to working tank 153 using the compressor. Vapor from vapor tank 150 may be transferred to wash tank 154 to raise the pressure in wash tank 154 above that of working tank 153 by opening valves 103 and 101 and starting compressor 152. Solution may then be transferred from wash tank 154 to working tank 153 by opening valves 111 and 112. When the desired amount of solution has been transferred, valves 111 and 112 may be shut, compressor 152 may be secured, and valves 101 and 103 may be shut.

The temperature of the system may increase for a number of reasons, including, but not limited to, heat input from pumping cleaning solution, heat input from ambient and heat input from warming clothes in wash tank 154. It may be desirable to cool down the system for several reasons including maintaining optimal system conditions and preventing overpressure.

Cleaning solution in wash tank 154 may be cooled by transferring vapor from wash tank 154 to condenser 151, condensing the vapor there, and transferring the liquid carbon dioxide to working tank 153. Transferring vapor from wash tank 154 may cause the pressure in wash tank 154 to drop slightly, which may cause vaporization of some of liquid cleaning solution, resulting in removal of heat due to the heat of vaporization of the boiled liquid. The quantity of vapor transferred may be small enough that the differential pressure between wash tank 154 and condenser 151 should provide sufficient driving force to move the vapor. Additionally, the quantity of cleaning solution vaporized may be small enough that no cleaning solution need be added back to the wash tank. Vapor may be transferred by opening valves 101, 105, and 114 causing vapor to flow through lines 124, 122, and 127, condense in condenser 151, and flow as liquid through line 128 into working tank 153. When the solution in wash tank 154 has been sufficiently cooled, valves 101, 105, and 114 may be shut.

Similarly, cleaning solution in working tank 153 may be cooled by transferring vapor from working tank 153 to condenser 151, condensing the vapor there, and returning the liquid carbon dioxide to working tank 154 as follows. Valve 114 may be opened, bringing condenser 151 on-line and allowing vapor in line 128 to condense. When the solution in working tank 153 has been sufficiently cooled, valve 114 may be shut.

Alternatively, vapor from wash tank 154 may be transferred to vapor tank 150, which may be maintained at a pressure sufficiently below the pressure of wash tank 154 such that the pressure differential between the two tanks drives vapor flow. During a wash cycle, vapor tank 150 is preferably maintained at a pressure less than about 300 psig. Vapor transfer may be performed by opening valves 101 and 104. When the cleaning solution in wash tank 154 reaches the desired temperature, valves 101 and 104 can be shut. The vapor thus transferred may be transferred to condenser 151 using compressor 152 and the resulting liquid carbon dioxide returned to working tank 153 by opening valves 103, 105, and 114 and starting compressor 152 causing vapor to flow through lines 121, 123, 121, 122, and 127, condense in condenser 151 and flow as liquid through line 128 into working tank 153. When the desired amount of vapor has been transferred compressor 152 can be secured and valves 103, 104, and 114 shut.

Similarly, vapor may be transferred from working tank 153 to vapor tank 150 to provide desired cooling to solution in working tank 153 as follows. With valve 114 shut, such that condenser 151 is off-line, valves 105 and 104 may be opened, transferring vapor from working tank 153, which is at a higher pressure, to vapor tank 150, which is at a lower pressure. Preferably, working tank 153 is at system pressure described above and vapor tank is at a pressure less than system pressure, preferably less than 500 psig, more preferably less than 300 psig. Transferring vapor from working tank 153 may cause the pressure in working tank 153 to drop slightly, which may cause vaporization of some of the liquid cleaning solution, resulting in removal of heat due to the heat of vaporization of the boiled liquid. This vapor may be condensed and returned to the working tank as described above.

Referring now to FIG. 7, a carbon dioxide dry cleaning system employing a vapor tank and a liquid carbon dioxide collecting tank will now be described. Valves 201–215, lines 225–241, and equipment 250–253 and 260 correspond to valves 101–115, lines 120–136, and equipment 150–156 and 160 in FIG. 6. Additionally, a wash cycle for the system shown in FIG. 7 occurs as described above for the system shown in FIG. 6.

Liquid carbon dioxide collecting tank 259 collects liquid $CO_2$, which may then be used in a variety of ways described below. Liquid carbon dioxide collecting tank 259 has an inlet line 229 and an outlet line 231. Inlet line 229 is connected to line 228, the outlet to condenser 251, such that when liquid flows through line 228 from condenser 251 to working tank 253, the liquid is diverted to liquid carbon dioxide collecting tank 259. Outlet line 231 runs between liquid carbon dioxide collecting tank 259 and wash tank 254. In a preferred embodiment, the elevation of liquid carbon dioxide collecting tank 259 is higher than that of wash tank 254 such that fluid in liquid carbon dioxide collecting tank 259 may be gravity fed through line 231 into wash tank 254 by opening valves 206, 205, and 201. Liquid carbon dioxide collecting tank 259 should have a sufficient volume to perform desired procedures such as rinsing the contents of wash tank 254 or washing filter 257. Liquid carbon dioxide collecting tank preferably has a capacity of about 5 to about 30 gallons and more preferably has a capacity of about 5 to about 15 gallons. When liquid carbon dioxide collecting tank 259 is full, its excess contents may spill out through lines 229 and 228 into working tank 253.

Liquid carbon dioxide collecting tank 259 may be filled with liquid $CO_2$ from a number of different sources either individually or in combination including the following. One source of liquid $CO_2$ may be working tank reflux. The cleaning solution in working tank 253 may heat up due to heat transfer into the tank from higher ambient temperatures. If this happens, the cleaning solution may begin to boil. Vapor will travel from the vapor space in working tank 253 through line 228 into condenser 251. When valve 214 is open and condenser 251 is on-line, the vapor condenses and flows back down line 228 as liquid $CO_2$. This liquid $CO_2$ will flow through line 229 into liquid carbon dioxide collecting tank 259. Another source of liquid $CO_2$ may be the $CO_2$ that condenses during the vapor removal step described above for the system in FIG. 4 where valve 214 is opened and condenser 251 is brought on-line, valve 205 is opened and some of the vapor flowing through line 222 begins to flow through line 227, condense in condenser 251, and flow as liquid through line 228. This liquid $CO_2$ flows into liquid carbon dioxide collecting tank 259. Yet another source of liquid $CO_2$ may be $CO_2$ condensed from distillation of cleaning solution in still 258. Cleaning solution may be transferred to still 258 and distilled to separate the $CO_2$ solvent from surfactants and contaminates among other things. Cleaning solution is transferred by opening valves 211, and 218 and starting pump 255. When the desired amount of cleaning solution has been transferred, pump 255 is secured and valves 210 and 212 are shut. The cleaning solution in still 258 is distilled by opening valve 216, bringing still 258 on-line. Valve 214 is opened and condenser 251 is brought on-line, then valves 207 and 205 are opened and vapor flows from still 258 through lines 240, 232, 222, and 227 into condenser 251 where it condenses. Liquid $CO_2$ then flows through lines 228 and 229 into liquid carbon dioxide collecting tank 259. Still another source of liquid $CO_2$ may be wash tank reflux that occurs when liquid in wash tank 254 is heated by opening valve 215, bringing heating element 256 on-line. Valve 214 is opened and condenser 251 is brought on-line, then valves 208, 207, and 205 are opened. Vapor flows from wash tank 254 through lines 232, 222, and 227 into condenser 251 where it condenses. The liquid $CO_2$ flows through lines 228 and 229 into liquid carbon dioxide collecting tank 259. Another source of liquid $CO_2$ may be vapor transfer from vapor tank 250 after a system cooling procedure has been performed as described above for the system in FIG. 6.

Liquid $CO_2$ in liquid carbon dioxide collecting tank 259 may be used to rinse clothes in wash tank 254 as follows. Liquid carbon dioxide collecting tank 259 has been filled with liquid $CO_2$ as described above. A wash cycle, as described above for the system in FIG. 4, proceeds through the extraction step. Valves 206, 205, and 201 are opened allowing the contents of the liquid carbon dioxide collecting tank 259, in this case liquid $CO_2$, to flow through line 231 into wash tank 254. When the desired amount of liquid $CO_2$ has been added to wash tank 254, valves 206, 205, and 201 are shut. Clothes in wash tank 254 are contacted with the liquid $CO_2$ for a sufficient amount of time to rinse any residual cleaning solution from the clothes. The drain and extraction steps described above for the system in FIG. 6 are then repeated to remove the rinse solution from wash tank 254, and the carbon dioxide vapor in wash tank 254 may be removed as described above for the system in FIG. 6. Liquid carbon dioxide collecting tank 259 may be refilled by one of the methods described above.

Liquid in liquid carbon dioxide collecting tank 259 may be used to wash filter 257. One who is skilled in the art will appreciate that the cleaning system could include one or more than one filter in many different configurations. Liquid carbon dioxide collecting tank 259 has been filled with liquid carbon dioxide as described above. A wash of the filter may be performed as a periodic operation. In the preferred embodiment, a wash may be performed on a weekly basis, more preferred for commercial operations at a time when cleaning operations are not scheduled. The filter wash may be initiated by employees as they leave for the day. The cycle would commence and follow a normal wash cycle, as described above for the system in FIG. 6, through the vapor charging step with the exception that no clothes would be added to wash tank 154. During this time, additives may be added to the liquid $CO_2$ in liquid carbon dioxide collecting tank 259 through additive injection port 217 to form a filter wash solution. These additives may shift the adsorption equilibrium of adsorbed dyes or other contaminants such that they become soluble in liquid carbon dioxide. The precise additive needed to clean filter 257 will depend on the type of contaminant to be removed from it and will be known to those skilled in the art.. If no additives are added to liquid carbon dioxide collecting tank 259, the filter wash solution consists of liquid carbon dioxide.

The contents of liquid carbon dioxide collecting tank 259 are added to wash tank 254 by opening valves 206, 205, and 201, allowing the filter wash solution to flow through line 231. When the desired amount of filter wash solution has been transferred to wash tank 254, valves 206, 205, and 201 are shut. Valves 211, 218, and 208 are opened and pump 255 is started. Filter wash solution is circulated from wash tank 254 through lines 235 and 238, through filter 257, through lines 239 and 241, through still 258, which is off-line, and through lines 240 and 232 back to wash tank 254. After washing filter 257 for a sufficient amount of time, preferably between about 1 and 600 minutes, most preferably between 1 and 20 minutes, the filter wash solution may be transferred either to working tank 254 or to still 258. Filter wash solution may be transferred to working tank 254 by shutting valve 208 and opening valves 209, 201, and 205. When wash tank 254 is empty, pump 255 is secured and valves 211, 218, 209, 201, and 205 are shut. Alternatively, filter wash solution may be transferred from wash tank 254 to still 258 by shutting valve 208. When wash tank 254 is empty, pump 255 is secured and valves 218 and 211 are shut. Filter 257 may be positioned at an elevation above still 258 so that filter 257 may be drained into still 258 by gravity. The filter wash solution may then be distilled by opening valves 207 and 205, then opening valves 216 and 214, bringing the still and the condenser on-line. Vapor from the still travels through lines 240, 232, 222, 227, condenses in condenser 251, then liquid carbon dioxide travels through line 228 into liquid carbon dioxide collecting tank 259. When the contents of still 258 have been distilled, valves 216, 214, 207, and 205 are shut. Carbon dioxide vapor in wash tank 254 may be removed as described above for the system in FIG. 6. Liquid carbon dioxide collecting tank 259 may be refilled by one of the methods described above.

Liquid in liquid carbon dioxide collecting tank 259 may be used to help remove non-volatile residues present on clothes in wash tank 254 after the wash cycle. Liquid carbon dioxide collecting tank 259 has been filled with liquid $CO_2$ as described above. A wash cycle, as described above for the system in FIG. 6, proceeds through the extraction step. Before the vapor removal step, a second step may be performed as follows. Valves 206, 205, and 201 are opened allowing the contents of the liquid carbon dioxide collecting tank 259, in this case liquid $CO_2$, to flow through line 231 into wash tank 254. Clothes in wash tank 254 are contacted with the liquid $CO_2$ for a sufficient amount of time to remove some or all of the remaining non-volatile residues from the clothes. During this time, heating element 256 is brought on-line by opening valve 215. As the liquid in wash tank 254 boils, the carbon dioxide vapor created condenses on the cooler clothes that are in wash tank 254, which may extract the residues. The condensed carbon dioxide vapor falls back to the bottom of wash tank 254 and may be reboiled. After this second extraction step has been performed for a sufficient time, heating element 256 is taken off-line by shutting valve 215. The drain and extraction steps described above for the system in FIG. 6 may be repeated to remove the liquid from wash tank 254. Wash tank 254 may be depressurized as described above for the system in FIG. 6. Liquid carbon dioxide collecting tank 259 may be refilled by one of the methods described above.

As noted above, The present invention may be carried out in an any suitable carbon dioxide dry cleaning apparatus, particularly an apparatus as described in J. McClain et al., copending U.S. patent application Ser. No. 09/047,013 (filed Mar. 24, 1998); an apparatus as described in J. McClain et al., copending U.S. patent application Ser. No. 09/306,360 (filed May 6, 1999)(disclosing a direct drive system); an apparatus as disclosed in J. DeYoung et al., copending U.S. patent application Ser. No. 09/312,556 (filed May 14, 1999); and an apparatus as described in U.S. patent application Ser. No. 09/405,619, filed Sept. 24, 1999, to McClain et al. entitled System for the Control of a Carbon Dioxide Cleaning Apparatus which is commonly assigned to the assignee of the present invention, the disclosures of all of which is incorporated by reference herein in its entirety.

In the drawings and specification, there have been disclosed typical preferred embodiments of the invention and, although specific terms are employed, they are used in a generic and descriptive sense only and not for purposes of limitation, the scope of the invention being set forth in the following claims.

What is claimed is:

1. A method of delivering dry cleaning services, comprising the steps of:

(a) providing a carbon dioxide dry-cleaning process said dry cleaning process comprising, at a dry cleaning facility, the step of receiving from a source a dry cleaning solvent, wherein said dry cleaning solvent consists of beverage quality carbon dioxide; and then (b) franchising said process to a plurality of different owners to provide a plurality of different dry cleaning facilities employing said carbon dioxide dry-cleaning process at a plurality of different locations.

2. A method according to claim 1, wherein said dry cleaning process comprises, at a dry cleaning facility the steps of:

(a) receiving a concentrated detergent formulation at said cleaning facility;

(b) accepting from customers soiled articles to be cleaned at said cleaning facility;

(c) mixing said dry cleaning solvent and said concentrated detergent formulation to provide a dry cleaning formulation comprised of from 40 to 99 percent by weight of carbon dioxide solvent;

(d) cleaning said articles in a cleaning apparatus to produce cleaned articles;

(e) at least periodically distilling said dry cleaning formulation to produce a still residue comprising surfactant and soil; and (f) returning said cleaned articles to said customers.

3. A method according to claim 2, further comprising the step of (g) returning said still residue to a waste collector for incineration, reclamation, or recycling.

4. A method according to claim 2, wherein said concentrated detergent formulation is a liquid.

5. A method according to claim 4, wherein said concentrated detergent formulation further comprises a cosolvent.

6. A method according to claim 5, wherein said concentrated detergent formulation comprises from 5 to 95 percent by weight of cosolvent, and wherein said dry cleaning formulation comprises from 0.1 to 60 percent by weight of said cosolvent.

7. A method according to claim 6, wherein said cosolvent comprises an organic cosolvent.

8. A method according to claim 7, wherein said cosolvent comprises a biodegradable organic cosolvent.

9. A method according to claim 7, wherein said cosolvent has a flash point above 140° F.

10. A method according to claim 7, wherein said concentrated detergent formulation comprises from 5 to 95 percent by weight of surfactant, and said dry cleaning formulation comprises from 0.1 to 10 percent by weight of said surfactant.

11. A method according to claim 7, wherein said mixing step is carried out in said cleaning apparatus.

12. A method according to claim 2, wherein said cleaning apparatus comprises a wash vessel, a working vessel connected to said wash vessel, a pump operatively associated with said wash vessel, and a still operatively associated with said working vessel.

13. A method according to claim 12, wherein said concentrated detergent formulation is received by said cleaning facility in a container, and said still residue is returned to said waste reprocessor in the same said container.

14. A method according to claim 13, wherein said container is a 1 to 100 gallon container.

15. A method according to claim 13, wherein not more than 5% by weight of said carbon dioxide solvent in said dry cleaning formulation in said apparatus is lost to the atmosphere during each cleaning cycle.

16. A method according to claim 1, wherein said dry cleaning solvent is received at said cleaning facility as a cryogenic liquid.

* * * * *